US011731383B2

(12) United States Patent
Paubel

(10) Patent No.: US 11,731,383 B2
(45) Date of Patent: Aug. 22, 2023

(54) DEVICE HAVING A CHANGEABLE TOOL FOR PROCESSING WORKPIECE SHEETS

(71) Applicant: BOBST MEX SA, Mex (CH)

(72) Inventor: Anthony Paubel, Montagnat (FR)

(73) Assignee: BOBST MEX SA

( * ) Notice: Subject to any disclaimer, the term of this patent is extended or adjusted under 35 U.S.C. 154(b) by 112 days.

(21) Appl. No.: 16/097,409

(22) PCT Filed: May 10, 2017

(86) PCT No.: PCT/EP2017/025115
§ 371 (c)(1),
(2) Date: Oct. 29, 2018

(87) PCT Pub. No.: WO2017/194199
PCT Pub. Date: Nov. 16, 2017

(65) Prior Publication Data

US 2019/0152181 A1 May 23, 2019

(30) Foreign Application Priority Data

May 13, 2016 (DE) ..... 20 2016 102 593.1

(51) Int. Cl.
*B31B 50/00* (2017.01)
*B31B 50/20* (2017.01)
(Continued)

(52) U.S. Cl.
CPC ..... *B31B 50/006* (2017.08); *B26D 5/00* (2013.01); *B26D 7/26* (2013.01); *B26F 1/40* (2013.01);
(Continued)

(58) Field of Classification Search
CPC ..... B31B 50/006; B31B 50/14; B31B 50/20; B31B 50/26; B31B 50/62; B31B 50/88;
(Continued)

(56) References Cited

U.S. PATENT DOCUMENTS

RE32,817 E * 1/1989 Vossen ..... B26D 9/00 493/1
5,517,310 A * 5/1996 Paquette ..... G01B 11/24 356/615
(Continued)

FOREIGN PATENT DOCUMENTS

CN 1625452 A 6/2005
DE 44 21 011 A1 1/1996
(Continued)

OTHER PUBLICATIONS

International Search Report dated Oct. 24, 2017 in corresponding PCT International Application No. PCT/EP2017/025115.
(Continued)

*Primary Examiner* — Andrew M Tecco
*Assistant Examiner* — Jacob A Smith
(74) *Attorney, Agent, or Firm* — Ostrolenk Faber LLP

(57) ABSTRACT

A device for processing workpiece sheets for packaging, includes a processing station through which the workpiece sheets are transported in succession, at least one changeable tool (2, 10, 18) that is specific to the processing and is moved against the sheet introduced in the processing station to process the sheet, at least one holder (11) on the device side for the changeable tool (2, 10, 18), the holder being adjustable for aligning the changeable tool (2, 10, 18), a central electronic control unit (37) for controlling the device, the control unit (37) having a memory for storing specific setting position data for each individual specific changeable tool (2, 10, 18), electronic digital sensors (36) for determining the current position of the holder (11), which sensors are coupled to the control unit (37), and digital display devices (38) that are coupled to the control unit (37) and display the target position and the actual position of the holder (11) or of parts coupled thereto, or display the relation of the target
(Continued)

position and the actual position for the individual specific changeable tool (2, 10, 18).

14 Claims, 2 Drawing Sheets

(51) Int. Cl.

| | |
|---|---|
| ***B31B 50/88*** | (2017.01) |
| ***B31B 50/26*** | (2017.01) |
| ***B31B 50/62*** | (2017.01) |
| ***B41F 19/02*** | (2006.01) |
| ***B41F 19/06*** | (2006.01) |
| ***B44B 5/00*** | (2006.01) |
| ***B26D 5/00*** | (2006.01) |
| ***B26D 7/26*** | (2006.01) |
| ***B26F 1/40*** | (2006.01) |
| *B31B 100/00* | (2017.01) |
| *B31B 120/70* | (2017.01) |

(52) U.S. Cl.
CPC ..... *B31B 50/20* (2017.08); *B31B 50/26* (2017.08); *B31B 50/62* (2017.08); *B31B 50/88* (2017.08); *B41F 19/02* (2013.01); *B41F 19/064* (2013.01); *B44B 5/0095* (2013.01); *B26D 2007/2607* (2013.01); *B31B 2100/00* (2017.08); *B31B 2120/70* (2017.08)

(58) Field of Classification Search
CPC ... B31B 2100/00; B31B 2120/70; B26D 5/00; B26D 5/02; B26D 5/06; B26D 7/26; B26D 2007/2607; B26F 1/40; B41F 19/02; B41F 19/064
USPC ..... 493/16, 128, 55, 17, 8, 468
See application file for complete search history.

(56) References Cited

U.S. PATENT DOCUMENTS

| | | | | | |
|---|---|---|---|---|---|
| 5,784,939 | A * | 7/1998 | Rebeaud | B26D 7/1818 | 83/563 |
| 6,245,004 | B1 * | 6/2001 | Waters | B31B 50/00 | 493/61 |
| 6,520,057 | B1 * | 2/2003 | Steadman | B26D 5/00 | 700/134 |
| 6,718,856 | B2 * | 4/2004 | De Dompierre | B26D 7/1818 | 493/372 |
| 6,823,763 | B1 * | 11/2004 | Foster | B26D 5/00 | 269/21 |
| 8,926,485 | B2 * | 1/2015 | Diehr | B41J 3/32 | 493/16 |
| 9,869,990 | B1 * | 1/2018 | Galavotti | G05B 19/4097 | |
| 2003/0036468 | A1 * | 2/2003 | Blank | B26F 1/04 | 493/8 |
| 2003/0140762 | A1 * | 7/2003 | Dietz | B26D 7/27 | 83/746 |
| 2005/0172775 | A1 * | 8/2005 | Lee | B26D 5/16 | 83/628 |
| 2006/0207401 | A1 * | 9/2006 | Wu | B26D 1/025 | 83/614 |
| 2006/0242818 | A1 * | 11/2006 | Penick | B25J 9/04 | 29/560 |
| 2007/0163414 | A1 * | 7/2007 | Senda | B21D 37/145 | 83/684 |
| 2011/0209529 | A1 * | 9/2011 | Hyatt | B24B 49/04 | 73/37.5 |
| 2011/0219924 | A1 * | 9/2011 | Cummings | B26D 5/00 | 83/39 |
| 2012/0048131 | A1 * | 3/2012 | Diehr | B41J 3/32 | 101/3.1 |
| 2012/0053034 | A1 * | 3/2012 | Diehr | B44B 5/00 | 493/55 |
| 2013/0165310 | A1 * | 6/2013 | Barrer | B65H 45/30 | 493/468 |
| 2013/0228056 | A1 * | 9/2013 | Beguin | B26F 1/40 | 83/102 |
| 2014/0030963 | A1 * | 1/2014 | Kanazawa | B24C 3/02 | 451/87 |
| 2014/0170935 | A1 * | 6/2014 | Maurer | B26D 5/00 | 451/8 |
| 2015/0298417 | A1 * | 10/2015 | Cay | B31B 50/00 | 493/320 |
| 2016/0008998 | A1 * | 1/2016 | Denisse | B31F 1/07 | 493/471 |
| 2018/0178478 | A1 * | 6/2018 | Kodama | B31B 50/146 | |
| 2018/0222004 | A1 * | 8/2018 | Jacot | B23Q 17/24 | |
| 2019/0152181 | A1 * | 5/2019 | Paubel | B26D 7/26 | |

FOREIGN PATENT DOCUMENTS

| | | | | |
|---|---|---|---|---|
| DE | 297 07 792 | U1 | 7/1997 | |
| DE | 10052576 | A1 | 5/2002 | |
| DE | 601 14 704 | T2 | 7/2006 | |
| DE | 102008024558 | A1 | 11/2009 | |
| DE | 10 2013 000 299 | A1 | 7/2014 | |
| DE | 102013000299 | A1 * | 7/2014 | B30B 15/0094 |
| EP | 0 096 564 | A2 | 12/1983 | |
| EP | 1155791 | A2 | 11/2001 | |
| EP | 2 422 969 | A1 | 2/2012 | |
| EP | 2 610 201 | A1 | 7/2013 | |
| EP | 2740672 | A1 | 6/2014 | |
| JP | S54-13086 | A | 1/1979 | |
| JP | H01-13998 | B2 | 3/1989 | |
| JP | H08-1794 | Y2 | 1/1996 | |
| JP | H10-133731 | A | 5/1998 | |
| JP | H11-320326 | A | 11/1999 | |
| JP | 2000-276461 | A | 1/2000 | |
| JP | 3336203 | B2 | 10/2002 | |
| JP | 3443121 | B2 | 9/2003 | |
| JP | 2004-277132 | A | 10/2004 | |
| JP | 2014-123912 | A | 7/2014 | |
| JP | 2016-117151 | A | 6/2016 | |
| KR | 10-0440033 | B1 | 7/2004 | |
| WO | WO 2012/136373 | A2 | 10/2012 | |

OTHER PUBLICATIONS

Written Opinion dated Oct. 24, 2017 in corresponding PCT International Application No. PCT/EP2017/025115.

* cited by examiner

DEVICE HAVING A CHANGEABLE TOOL FOR PROCESSING WORKPIECE SHEETS

CROSS-REFERENCE TO RELATED APPLICATIONS

The present application is a 35 U.S.C. §§ 371 national phase conversion of PCT/EP2017/025115, filed May 10, 2017, which claims priority of German Patent Application No. 20 2016 102 593.1, filed May 13, 2016, the contents of which are incorporated by reference herein. The PCT International Application was published in the English language.

TECHNICAL BACKGROUND

The invention relates to a device for processing workpiece sheets, in particular for processing sheets of paper, cardboard or plastic.

Such sheets of paper, cardboard (including corrugated board) or plastic are further processed in several steps, in particular for packaging. For example, a plurality of blanks on the same sheet are die-cut and subsequently separated in a flat bed die-cutting press with an adjoining flat bed stripping device. The stripping device comprises a station in which the so-called "waste" is detached from the sheet, and a subsequent station referred to as a blank separation station, in which individual blanks are pushed out of the sheet and placed on a pile. In a further device which is referred to as a folder-gluer, the blanks are folded and glued in sections so as to produce a sturdy box.

The device according to the invention relates not only to the above flat bed die-cutting presses and flat bed stripping devices, but also to a printing machine by means of which the sheets of paper, cardboard or plastic are printed or laminated, as well as to devices in which the sheets are embossed in order to generate creases in the later blanks for the creasing process.

These devices have the problem in common that for each kind of packaging, a dedicated tool has to be manufactured, referred to as a "changeable tool" below. For flat bed die-cutting devices, these tools are plates which have cutting knives or pressure pads attached thereto; for flat bed stripping devices, these are pins and pressure pads by means of which the waste or the blank is separated from the sheet. This means that such devices include an upper and a lower changeable tool, which simultaneously act on the sheet to be processed.

In a flat bed stripping device, for example, the following steps are carried out for aligning the upper and lower changeable tools. First, the lower changeable tool is inserted into the device, then a sheet that passes through the device and was cut in the preceding die-cutting station is transported into the stripping station and stopped there. The cut sections are then separated from the sheet in order to set the positions of the openings in the lower changeable tool through which the cut-out parts then have to be moved, in relation to the cutting edges. Finally, the upper tool is inserted and aligned so as to correspond to the lower tool. For this alignment process, an operator in some cases needs to climb into the device for inspecting the different positions of the parts in relation to each other, partly from above and from below. This is time-consuming and strenuous.

The changeable tools always must be exactly adapted to the pressure applied and aligned with the edges of cut in the preceding station. If upper and lower changeable tools are provided, as is the case in the die-cutting or stripping processes, for example, these tools further need to be precisely aligned with each other. The alignment is effected manually by adjusting the holders, located on the device side, for the changeable tools in the X- and Y-directions and also in the direction of rotation in a plane parallel to the plane of the sheets supplied, by means of spindles, screws, gearwheels and manually drivable wheels. The individual positions of the holders are ascertained in that the positions of parts of the adjustment means or of the holders are ascertained and permanently measured during the setting process. For this purpose, mechanical or mechanical-digital position indicators are employed, which detect and indicate the positions of adjustable parts of the holders or of the adjustment means coupled to them. The operator first has to do a test run of the device upon setting and then readjust it intuitively on the basis of the production results (trial and error). This process may take an experienced operator roughly 20 minutes. Since several different sheets are processed in the course of one day, the device has to be set up several times each day, which results in a considerable loss of production. To minimize such loss of production, the optimum setting parameters are noted down on the tools, and the tools are provided with respective sticky labels and archived with them. In the case of a reinstallation, the holder then only needs to be set to the previously determined positions, as in a coordinate system. This provides for a substantial gain in time.

SUMMARY OF THE INVENTION

The object of the invention is to improve a device for processing workpiece sheets such that the resetting process can be effected even more safely and faster.

The object is achieved by a device for processing workpiece sheets, in particular for processing sheets of paper, cardboard or plastic for packaging, including a processing station through which the workpiece sheets are transported in succession, at least one changeable tool that is specific to the processing and is moved against the sheet introduced in the processing station to process the sheet, at least one holder on the device side for the changeable tool, the holder being adjustable in several directions for aligning the changeable tool, a central electronic control unit for controlling the device, the control unit having a memory for storing specific setting position data for each individual specific changeable tool, electronic digital sensors for determining the current position of the holder, which are coupled to the control unit, and digital display devices that are coupled to the control unit and display the target position and the actual position of the holder or of parts coupled thereto for each individual specific changeable tool.

The invention does not make use of the changeable tools to inseparably provide a data memory thereon, for example, but uses the control unit, existing in any case, of the device in order to save the specific optimum setting position data for each individual specific changeable tool here. Furthermore, the invention for the first time utilizes electronic digital sensors to determine the current position of the holder and thus of the changeable tool, with the sensors, for system-related reasons, requiring no mechanical parts in order to detect the position of the sensed, adjustable part, as a result of which the accuracy of indication is independent of any wear. These electronic-digital sensors are adapted to be coupled to the control unit, in order that the control unit can store the setting position data automatically or at the touch of a button, as it were. When the changeable tool that has already been aligned once in an optimum manner previously is installed again later, digital display devices then not only display the target position, but also the current position of the holder for the individual specific changeable tool. In this way, the operator instantly receives all data for each holder required for bringing the holder to its target position immediately. As an alternative to indicating the target position and the current position, the relation between the target position and the current position may also be displayed. This is possible, for example, in that the display device is positioned next to the mechanical actuator for the adjustment and displays the required direction of movement for adjusting a setting wheel to the target position. When a handwheel is provided for adjustment of a spindle, for example, the display device can indicate the sense of rotation to reach the target position, and can indicate when the target position has been reached. The device can also control the position of a motor/actuator located in an inaccessible part of the device, allowing the operator to stay at the same place out of the device while doing the setting of the device and thus reducing time of changeover.

The target position and the current position may, for example, appear on the display device after a switchover. The preferred embodiment, however, provides for the display devices to display the target position and the current position at the same time to allow to have an eye on the target/actual comparison.

Preferably, the sensors are accommodated in one sensor unit each, which unit itself includes the display devices. Since the sensors are usually positioned in the vicinity of the adjustable parts of the manual adjustment means, the operator is able to look at the display while actuating the respective adjustment means. In addition, it is also of advantage from a structural aspect if the number of parts to be installed is as small as possible. A structural unit made up of the display device and the sensor reduces expenditures. The display devices in the sensor unit, however, receive the data via the control unit of the device and, therefore, centrally. In this way, the operator is prevented from inadvertently differently assigning data stored in sensor units, i.e. inadvertently retrieving data for an adjusting wheel that belong to a different changeable tool.

The coupling between the sensors, display devices and sensor units and to the control unit is in particular effected in a wired fashion, but may also be configured wirelessly.

As already mentioned, the sensors may be arranged on the associated holders or associated adjustment means, for example on drive spindles, or on parts driven by the adjustment means.

The shafts or spindles of the adjustment means extend through the sensors, for example, to provide optimum distances between the parts moving relative to one another, which increases the measuring accuracy.

The holder is usually mounted to be adjustable in two directions perpendicular to each other in a plane that is parallel to the sheet plane, that is, in the X- and Y-directions, and is also rotatable in this plane.

A tool seat that is in the form of guides and is rotatable and adjustable in two directions perpendicular to each other may be used for the holder. This tool seat may also be extendable to allow good access when the changeable tool is exchanged.

A carriage that is laterally extensible from the station, i.e. laterally in relation to the transport direction of the sheets, optimizes a rapid changing process.

The device according to the invention has its advantages in particular for machines of the type having upper and lower changeable tools with respectively associated upper and lower holders. The sheet to be processed is located between the upper and lower changeable tools, the sheet being processed by the upper and lower changeable tools, so that both changeable tools are aligned very precisely relative to each other. Examples of such a device are an embossing device or an stripping device.

The changeable tools are more particularly plates, in practice usually wooden boards, having individually attached, projecting processing tools such as cutting tools or holding or stripping pins.

The device is, more particularly, a flat bed die-cutting device, a flat bed stripping device that is positioned downstream of the die-cutting device, a sheet printing device, an embossing device, or a folder-gluer. All of these devices require a large amount of set-up effort when new sheets are to be processed.

BRIEF DESCRIPTION OF THE DRAWINGS

The drawings below show one variant of the device according to the invention.

DESCRIPTION OF AN EMBODIMENT

Figure 1:
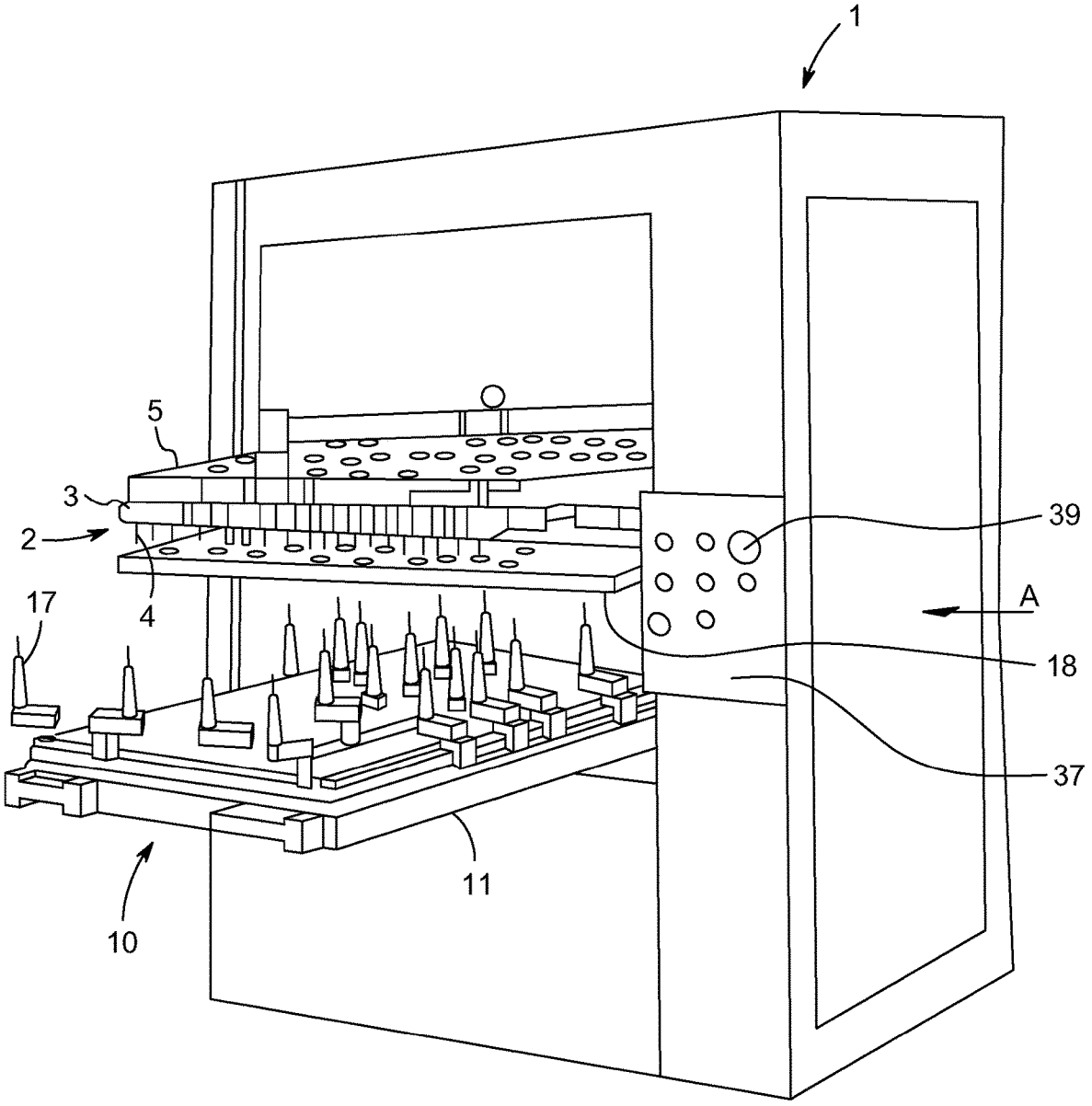
FIG. 1 shows a device in the form of a stripping station for separating die-cutting wastes or blanks cut from a sheet.

FIG. 1 illustrates a device, more precisely a station of a so-called flat bed die-cutting press in the form of a stripping or blank separation station. In this process, sheets of paper, cardboard, corrugated board or plastic which were printed or printed and laminated are transported through the device in the conveying direction A after die-cutting. The processing station shown is just one out of a plurality of stations immediately adjoining one another.

Provided in the device is an upper changeable tool 2 having a so-called stripping board 3 which has stripping pins 4 attached thereto which project downwards.

The upper changeable tool 2 is releasably fastened to a holder 5 for the batch to be processed, the holder being on the device side and being illustrated in a simplified fashion. In the illustrated embodiment, a holder is provided in the form of a laterally extensible carriage or sliding frame to which the stripping board 3 is fastened. But this carriage is provided only optionally.

An optionally provided lower changeable tool 10 is temporarily fastened to a lower holder 11 which is also in the form of a laterally extensible carriage. The changeable tool 10 comprises a board from which telescopic pins 17 protrude which project upwards and are in alignment with the stripping pins 4.

Optionally, a further lower changeable tool 18, in this case a stripping plate, may be provided between the changeable tools 2, 10, which has openings that are adapted in terms of size and geometry to the die-cutting wastes and are positioned directly below the die-cutting wastes to be stripped of the sheet lying on it. During separation, the tool closes, so that the upper changeable tool 2 moves downwards and the changeable tool 10 moves upwards, so that the die-cutting wastes are clamped between the pins 4, 17 and subsequently ejected downwards through the openings in the stripping plate. The changeable tool 18 is also mounted to an adjustable holder.

Sheets of different formats or different blanks always require separate specific changeable tools 2, 10, 18, but also different stripping plates.

The changeable tools 2, 10, 18 need to be inserted into their frame-type carriages, introduced into the device and be precisely aligned relative to each other and to the sheet there.

Figure 2:
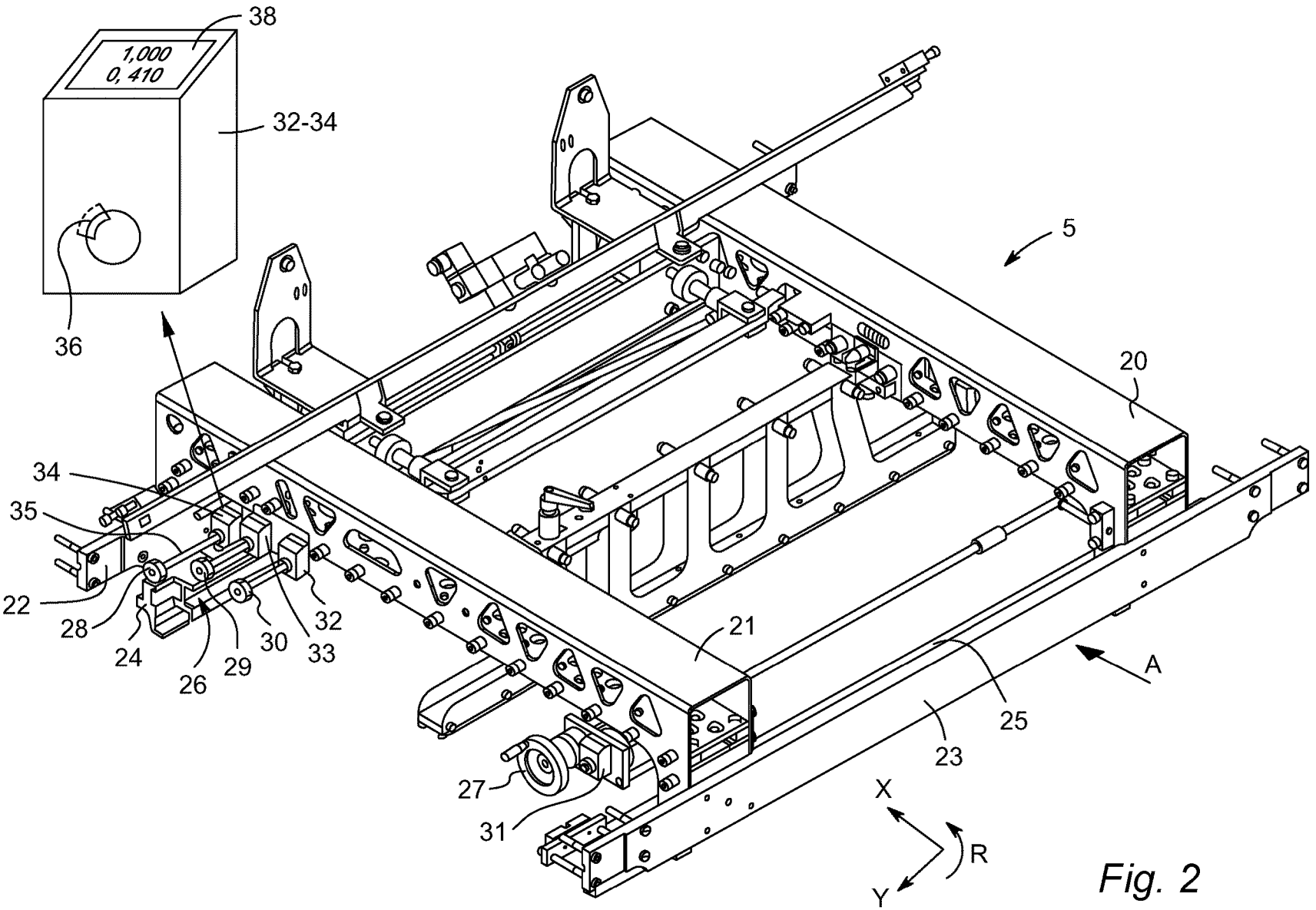
FIG. 2 shows a holder in the form of a sliding frame for the device according to FIG. 1, into which a variety of changeable tools can be inserted.

This is effected, for example, with the aid of the holder illustrated in FIG. 2. This holder 5 is intended for the upper changeable tool 2, but a corresponding holder is also provided for the lower changeable tools 10, 18.

Only the essential components of this holder 5 will be discussed below; for any details, reference is made to DE 601 14 704 T2, which describes the mechanical structure of the holder.

The holder 5 comprises a pair of carriers 20, 21 extending in the transport direction A and having transverse carriers 22, 23 fastened to their lower sides. In this way, a carrier structure is formed, to which a front guide 24, movable relative to the carrier structure, and a rear guide 25, illustrated somewhat concealed, are adjustably attached. The front guide 24 has a receiving groove 26 which extends over substantially the entire length of the guide 24. The rear guide 25 has a corresponding groove which faces the groove 26 and is not visible. The guides 24, 25 can be adjusted as desired by means of toothed racks, linkages and spindles in a plane parallel to the plane of the sheet lying thereunder, namely in an X-direction (direction of the moving sheet), a Y-direction, i.e. transversely to the X-direction, and in a rotational direction R. In addition, the distance between the guides 24, 25 can be varied by means of a manual adjustment means 27.

Further manual adjustment means 28, 29 and 30 serve to align the guides 24, 25 in the X-, Y- and rotational R directions.

Coupled to the adjustment means 27-30 are sensor units 31-34 which serve to detect the respective position. Here, the sensor unit 31-34 can scan the respective guide 24, 25 or parts connected to and moving with it and can detect the position thereof, or, as in the case of the sensor units 32-34, detect the position of the adjustment means 28-30, so that this allows a conclusion to be drawn about the respective positions of the guides 24, 25.

In the present case, shafts or spindles 35 extend through the sensor units 32-34. One of the shafts or spindles is provided with a reference number only symbolically, here the reference number 35.

Further, one of the sensor units 32-34 is symbolically shown on an enlarged scale. One or more sensors 36 is/are accommodated inside the sensor units 31-34 and detect(s) the position of the part moved by the adjustment means 27-30.

The sensors 36 or, in more general terms, all of the sensor units 31-34 are coupled to the central control unit 37 (see FIG. 1), either by an appropriate wiring or wirelessly.

A digital display device 38 is part of each sensor unit 31-34 and is electronically coupled to the associated sensor 36 of the sensor unit 31-34 at least via the control unit 37.

The digital display device 38 indicates the actual position that is detected by the associated sensor 36 (top line in FIG. 2) and an optimum target position (bottom line in FIG. 2).

The device allows indicating to the operator which way he has to rotate the handwheel (and how many turns until the current position matches the target position), firstly to reach the desired position but also to eliminate the mechanical slack, by rotating the handwheel in the way displayed on the device. This specific method can have the effect that the handwheel is turned further than expected or that it has to be turned in the opposite way and then turned back in the other way, in order to get away from mechanical slacks. Each setting has a specific method: from right to left, or from left to right, depending on the mechanical link between the holder and the part causing movement. If the operator doesn't follow the method, the green light button will never switch on and the setting will not be completed.

The target position is the optimum position for the desired optimum alignment of the specific changeable tool 2, 10 or 18 employed for the specific type of sheet to be processed.

Following the optimum set-up, the value established by the sensor 36 is stored in a memory of the control unit 37 by actuating an operating unit 39 on the central control unit 37. Further, an identifier for the job order, the changeable tools 2, 10, 18 or the associated sheet may be stored in the control unit using the operating unit 39.

When the changeable tools 2, 10, 18 are installed again later, the operator only retrieves the respective data in the control unit 37, for example by calling up the identifier for the job order (also called "recipe"), the changeable tools 2, 10 or the particular sheet.

The stored target positions are indicated in the respective display device 38, as is, furthermore, the actual position of the holder 5, more precisely the appropriate adjustment means 27-30 here. But since the position of the holder 5 and, therefore, of the changeable tool 2 is defined by means of the adjustment means 27-30, the position of the adjustment means 27-30 also directly determines the position of the holder, in this case the guides 24, 25.

The operator then only needs to adapt the actual position to the target position by means of the adjustment means 27-30.

The electronic digital sensors 36 allow a direct electronic coupling to the control unit 37, for example via a bus system.

Provision could, of course, also be made for a central display on or in the vicinity of the control unit 37, the central display reproducing all of the setting position data, the actual positions and also the target positions. However, the display devices 38 on the adjustment means are more advantageous from an ergonomic point of view.

The device reduces the set-up time from 20 minutes to several seconds up to a few minutes, which, for several resettings a day, translates into significantly higher production times of the device. Although the respective device has been discussed in the form of an stripping device, its principle, when appropriately adapted, may also be used for flat bed die-cutting devices, printing devices, embossing devices or folders-gluers.

The device can also display text messages.

The device can be switched off when the machine is running, reducing power consumption.

The invention claimed is:

1. A device for processing workpiece sheets, for packaging, the device comprising:

a processing station configured to receive the workpiece sheets in succession;

at least one changeable tool configured for the processing station and moved toward another changeable tool and against the sheet introduced in the processing station to process the sheet;

at least one holder on a device side for the changeable tool, the holder being configured to be positionally adjusted to a target position that optimally aligns the changeable tool with the another changeable tool;

a central electronic control unit configured for controlling the device, the control unit comprising a memory for storing target position data for the at least one target position;

electronic digital position sensors that output an actual position of the holder, and the sensors are coupled to the control unit;

adjusters for adjusting position of the holder;

the control unit is configured to store in the memory the actual position of the holder determined by the sensors;

the electronic digital sensors are configured to determine a current actual position of the holder;

and a digital display device coupled to the control unit and configured to display the target position and the current actual position of the holder or of parts coupled thereto, or to display a relation of the target position and the current actual position for the at least one changeable tool, wherein the sensors are coupled to the holder, wherein the control unit is programmed to cause display of direction of movement of an adjuster in order to reach the target position without mechanical slack.

2. The device according to claim 1, wherein the display device displays the target position and the current actual position at the same time.

3. The device according to claim 1, further comprising:

a plurality of digital display devices coupled to the control unit and configured to display the target position and the current actual position of the holder or of parts coupled thereto, or to display a relation of the target position and the current actual position for the individual specific changeable tool, wherein each sensor is accommodated in a sensor unit, each sensor unit including display device of the plurality of display devices, each display device for displaying the target position and the current actual position or of parts coupled thereto, or to display a relation of the target position and the current actual position for the individual specific changeable tool.

4. The device according to claim 1, wherein the adjusters comprise manual adjusters for adjusting the holder.

5. The device according to claim 1, wherein each adjuster a moving part detected by a sensor from the sensors that is accommodated in a sensor unit, and the moving part comprising a shaft or a spindle extending through the sensor unit.

6. The device according to claim 1, wherein the at least one holder is configured to be adjusted in two directions (X, Y) perpendicular to each other in a plane that is parallel to the sheet plane, and is rotatable in the plane.

7. The device according to claim 6, wherein the at least one holder includes a rotatable tool seat in the form of guides, which is adjustable in the two directions perpendicular to each other.

8. The device according to claim 1, wherein the at least one holder comprises a carriage that is laterally extensible from the station.

9. The device according to claim 1, wherein the at least one adjustable tool comprises upper and lower changeable tools, and the at least one holder comprises respectively associated upper and lower holders provided and between which the sheet to be processed is located, wherein the upper and lower changeable tools are configured to process the sheet.

10. The device according to claim 9, wherein the changeable tools are plates comprising individually attached, projecting processing tools.

11. The device according to claim 1, wherein the device is at least one of a flat bed die-cutting device, a flat bed stripping device, a sheet printing device, an embossing device, or a folder-gluer.

12. The device according to claim 1, wherein the control unit is programmed to cause display of the distance of movement of the adjuster in relation of the target and the current actual positions.

13. The device according to claim 1, wherein the sensors are at the adjusters associated with the at least one holder for adjusting the respective holder.

14. The device according to claim 13, wherein the adjusters drive parts, and wherein the sensors are at the parts driven by the adjusters.

* * * * *